United States Patent [19]

Hengstenberg et al.

[11] Patent Number: 4,537,017

[45] Date of Patent: Aug. 27, 1985

[54] MACHINE FOR FILLING JARS WITH PIECES OF VEGETABLES OR FRUITS, IN PARTICULAR QUARTERED PICKLES

[75] Inventors: Eckart Hengstenberg, Esslingen; Heinrich Disch, Hohengehren, both of Fed. Rep. of Germany

[73] Assignee: Firma Rich. Hengstenberg, Fed. Rep. of Germany

[21] Appl. No.: 497,385

[22] Filed: May 23, 1983

[30] Foreign Application Priority Data

May 22, 1982 [DE] Fed. Rep. of Germany ..... 3219340

[51] Int. Cl.[3] ..... B65B 5/10

[52] U.S. Cl. ..... 53/515; 53/236; 53/240; 53/244; 53/252

[58] Field of Search ..... 53/150, 236, 240, 244, 53/247, 252, 513, 514, 515; 83/167

[56] References Cited

U.S. PATENT DOCUMENTS

| | | | |
|---|---|---|---|
| 2,092,786 | 9/1937 | Taylor | 53/252 |
| 2,190,936 | 2/1940 | Balk | 53/515 |
| 2,701,674 | 2/1955 | Christiansen | 53/252 |
| 3,279,147 | 10/1966 | Garapolo | 53/252 |
| 3,461,646 | 8/1969 | Lane et al. | 53/515 |
| 3,468,098 | 9/1969 | Eisenberg | 53/515 |
| 3,662,518 | 5/1972 | Eisenberg | 53/515 |
| 4,453,368 | 6/1984 | Egee | 53/515 |

*Primary Examiner*—John Sipos
*Assistant Examiner*—Donald R. Studebaker
*Attorney, Agent, or Firm*—Jones, Tullar & Cooper

[57] ABSTRACT

A machine for filling jars with pieces of vegetables or fruits, in particular quartered pickles, is provided, in which a jar conveyor belt carries the jars incrementally past filling stations at which the pieces of the vegetables are fed into the jars. The pieces of vegetables or fruits are brought by a conveyor belt to cutting stations, where they are cut into the pieces, and are brought to the filling stations. The vegetables or fruits are fed from the cutting stations, in which they are cut into pieces, horizontally into magazines provided with a partition. These magazines are disposed on a revolving magazine belt, which is disposed obliquely relative to the jar conveyor belt, in such a manner that a plurality of filling stations is produced along the jar conveyor belt, in each of which a magazine is disposed in a different relative association in terms of its height with a jar.

6 Claims, 10 Drawing Figures

I
II
III
IV
V
1
2
3
4
5
6
7
7'
8
9
10
11
12
13
14
15
16
17
18
19
20
21
22
23
24
26
40
41
42
43
50
2x
3x
6x
16, 17, 18

MACHINE FOR FILLING JARS WITH PIECES OF VEGETABLES OR FRUITS, IN PARTICULAR QUARTERED PICKLES

BACKGROUND OF THE INVENTION

1. Field of the Invention

The present invention relates to a machine for filling jars with pieces of vegetables or fruits, and in particular quartered pickles. The machine includes a conveyor belt which carries jars incrementally past filling stations at which the pieces of vegetables are fed into the jars. The pieces of vegetables or fruits are delivered by a conveyor belt to cutting stations, where they are cut into pieces, and are then brought to the filling station.

2. Prior Art

A machine of this kind, in the form of a pickle feeding machine, is known from German Pat. No. 21 50 368. In this machine the pickles are transported in a horizontal position, then tilted into an upright position and pushed from top to bottom through cutting stations. In order to feed them into jars delivered upright on the jar conveyor belt in such a manner that the cut sides face the outside, the pieces cut in the cutting stations are guided along coiled guideways and thereby rotated about their own longitudinal axis.

It is very important for the cut sides of the pickle pieces resting on the inside of the jar to be visible from the outside, because it is then possible to tell whether the pieces are still firm and have a fresh appearance.

The known apparatus functions satisfactorily only when the pickles always have a very specific and unchanging diameter. This diameter must always be at a certain, never-changing ratio to the diameter of the jar. Then the pickle pieces, fed into the jar in an upright position, support one another along the circumference of the jar in a sort of "bridge effect", instead of collapsing inward again like pick-up sticks. Additionally, the inside of the jar, inside the outer ring of pickle pieces, must be filled by hand.

OBJECTS AND SUMMARY OF THE INVENTION

An object of the present invention is to provide a machine of the general type discussed above in which the pieces, preferably quarters, produced by cutting a pickle, for example, along its longitudinal axis can be fed by a machine into a jar or jars in such a manner that the cut sides are visible from the outside and it is thereby assured that this will be so even if the pickles vary in diameter, thus obviating preliminary sorting of the pickles by size.

A further object of the present invention is to attain the maximum possible extent of machine filling, so that finishing the filling operation by hand is necessary to only a small extent.

These objects are attained by the machine of the present invention which includes magazines provided with a horizontal partition in such a manner that the upper parts of the vegetables or fruits, and in particular pickles, above the partition rest on this partition, and the lower parts below the partition rest in the magazine. The magazines are disposed obliquely relative to a jar conveyor belt, so that a plurality of filling stations is provided along the jar conveyor belt, in each of which stations one magazine each has a different relative association, in terms of height, with a jar.

According to the invention the jars are transported in a horizontal position, that is, with their mouth toward the side. In a corresponding manner, the pickle pieces are inserted horizontally. This insertion is effected from a magazine, which is subdivided in such a manner that some pieces produced by the cutting apart of a pickle along its longitudinal axis rest above the partition, that is, upon it, while the other pieces of the pickle rest in the magazine below the partition. Thus when the pickle is cut into pieces, such as quarters, in the cutting station, two quarters, which are the upper half of the pickle, rest at the top on the partition, while the two quarters which are the lower half of the pickle rest in the magazine below the partition. With a feed piston of appropriate cross section, it is then possible to insert either only the top two quarters or only the bottom two quarters sideways into the jar. If there is a plurality of filled magazines, in which pieces of pickles are disposed in this way, then halves of pickles can be fed into the jar in sequence such that the quarters all, possibly reinforced by individual alignment mandrels, rest in the jar in such a manner that their cut sides show on the outside. In the various filling stations in sequence, the height at which the magazine is disposed relative to the jar varies from one station to the next, so that in each filling station the actual manner in which the jar was filled in the previous station can be taken into consideration. In this way, with the jar lying on its side, filling the pieces of pickles into the jars can be accomplished in the desired manner from bottom to top. At the same time, a high proportion of the jar can be filled in this way. In comparison with the capacity of known machines, the necessity for manual completion of the filling operation in order to fill the jar compactly is reduced substantially.

At the same time the problem which exists when filling jars from top to bottom as in the known apparatus, that the pieces are not securely positioned in the jars if the sizes of the quarters vary because of the variation in size of the pickles before cutting, is avoided.

One exemplary embodiment of the invention will be described in detail below, referring to the drawings.

FIGS. *7a* and *7b* are a front and side view, respectively, of a.magazine; and

Figures 1, 6:
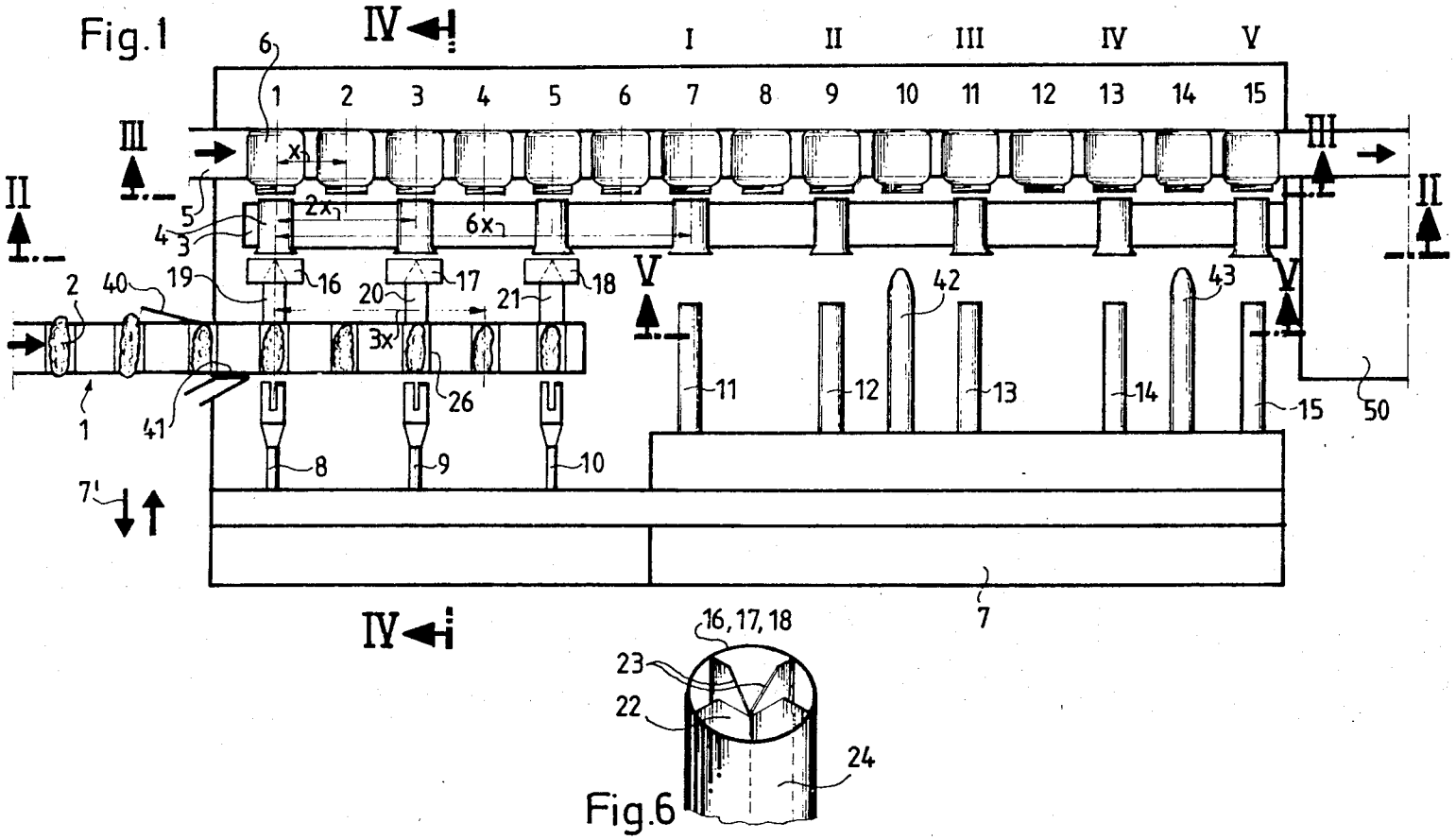
FIG. 1 is a schematic plan view of an exemplary embodiment.
FIG. 6 shows a cutting station.

FIGS. *8a* and *8b* are a front and side view, respectively, of a carrying dish, such as is used in FIG. 1.

DESCRIPTION OF THE PREFERRED EMBODIMENTS

The preferred embodiment will be described with reference to the filling of jars with pickles.

Figure 2:
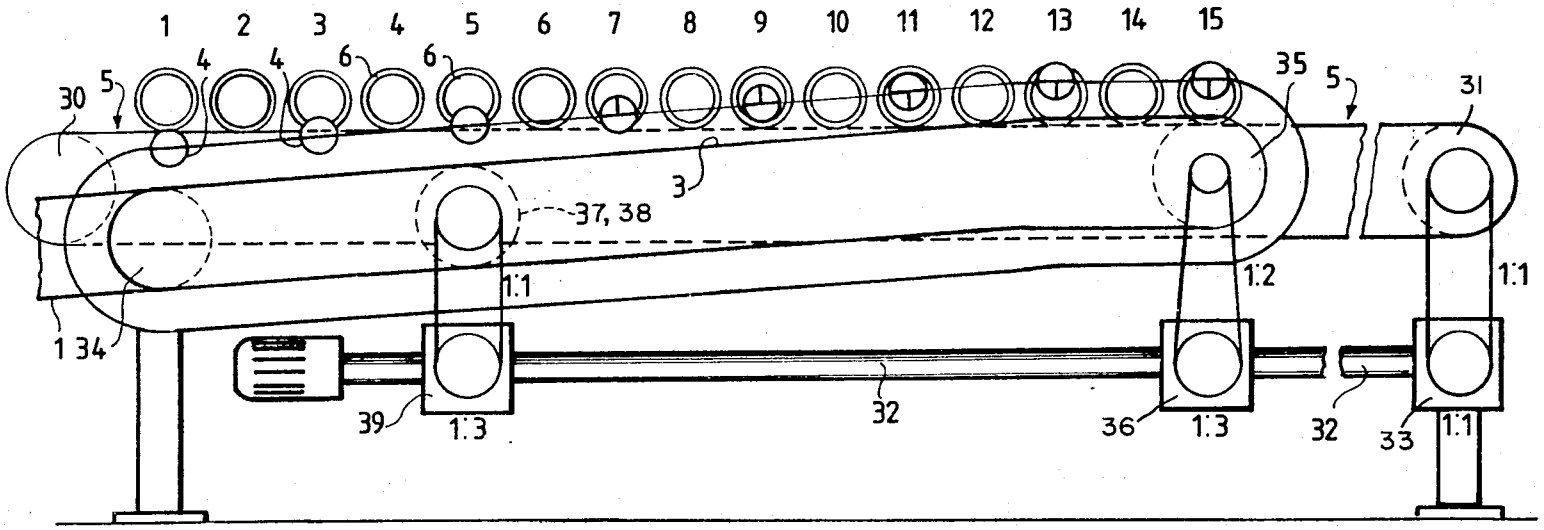
FIG. 2 is a section taken along the line II—II of FIG. 1 (again in schematic fashion)

A pickle jar filling machine according to FIGS. 1 and 2 has a continuous revolving pickle conveyor belt 1 for transporting pickles 2. A magazine belt 3 which is likewise continuous and revolving has magazines 4 situated thereon for receiving the pickles which have been cut into quarters, while a jar conveyor belt 5, which is also continuous and revolving is provided for transporting jars 6. The pickle conveyor belt 1, the magazine belt 3, and the jar conveyor belt 5 are moved in increments. For each increment, a jar 6 is moved by the distance x (equal to the interval between two jars), the magazine belt 3 is moved by the distance 6×(6 intervals between jars=3 intervals between magazines), and the jar conveyor belt 5 is moved by the distance 3×(3 intervals between jars=3 intervals between pickles) in the direction indicated by the arrows.

The machine also has a feed bar 7, which, per increment, is moved once at right angles to the direction of movement of belts 1, 3, 5 (see the arrows A). The feed bar 7 carries pistons 8–10, feed pistons 11–15, and alignment mandrels 42, 43.

Also located between the pickle conveyor belt 1 and the magazine belt 3 are cutting stations 16–18, which are preceded by centering devices 19–21, which are embodied basically as tubes which taper somewhat in conical fashion at their leading ends.

As may be seen in FIG. 6, each one of the cutting stations 16–18 is embodied to include two cutting knives 22, 23 disposed at right angles to one another inside a tube 24. On the leading end each cutting knife has a triangular notch for the purpose of centering the tool when beginning to cut. As the tool passes through a pickle 2, it cuts it into four quarters.

FIGS. *7a* and *7b* show a magazine 4. The magazine 4 is likewise embodied as a tube in which a partition 25 is horizontally disposed. At its leading edge, the magazine 4 is slightly conical. Now if (viewing from right to left in FIG. *7b*) a pickle which was previously cut into four identical quarters in the cutting station is inserted into a magazine 4, then the two upper quarters rest on the top of the partition 25, while the two lower quarters are located below the partition 25.

FIGS. *8a* and *8b* show details of the embodiment of the pickle conveyor belt 1 with carrying dishes 26, into which the pickles are placed.

The jar conveyor belt 5 for transporting the jars 6 is likewise embodied such that the jars can be placed at specific points on the jar conveyor belt 5 at uniform intervals from one another (not shown in detail).

Figure 4:
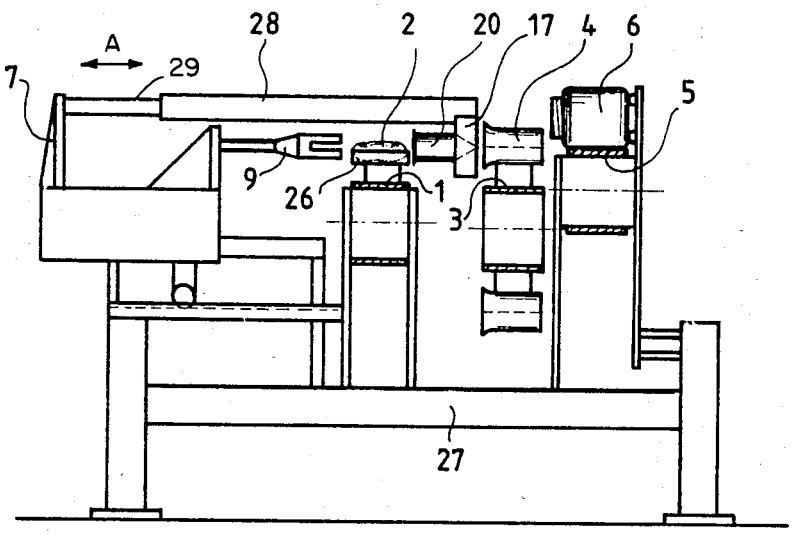
FIG. 4 is a section taken along the line IV—IV of FIG. 1.
Figure 7A:
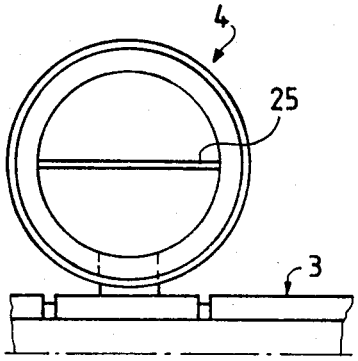
Figure 7B:
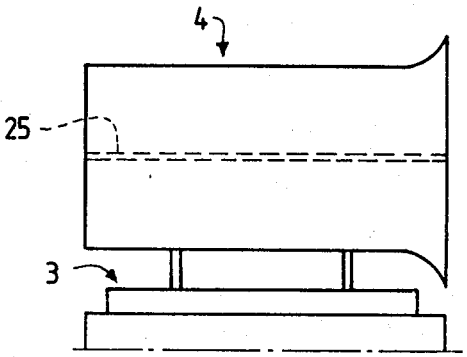
Figure 8A:
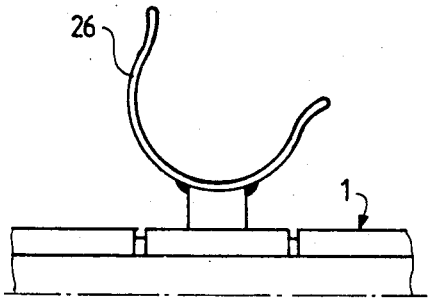
Figure 8B:
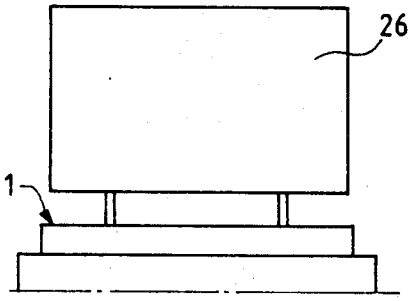

As may be seen in FIG. 4, the elements mentioned are disposed on a machine frame 27. The movement of the feed bar 7 is such that it executes the reciprocating movement indicated by the arrows A, effected by means of a cylinder 28, in which a piston (not shown) connected to the piston rod 29 is caused to reciprocate; the piston rod 29 in turn is secured on the feed bar 7, while the cylinder 28 is secured on the machine frame 27.

As may be seen in the schematic illustration of FIG. 2, the jar conveyor belt 5 is guided to revolve around wheels 30, 31. The wheel 31 is driven by a shaft 32 via a gear 23 having a translation ratio of 1:1 and a transmission effected via chains, which again have a translation ratio of 1:1. In principle, toothed belts could also be used.

The magazine belt 3 is guided to revolve around the wheels 34 and 35. The wheel 35 is driven by chains via a transmission having a translation ratio of 1:2 and a gear 36 having a translation ratio of 1:3, so that the overall translation ratio from the shaft 32 to the magazine belt 3 is 1:6; the result is that the magazine belt 3, as already mentioned, travels the distance 6× per increment.

Also shown in FIG. 2, is the pickle conveyor belt 1, which is guided to revolve around the wheels 37, 38. The drive is effected by the shaft 32 via a gear 39 having the translation ratio 1:3, so that the result in comparison with the jar conveyor belt 5 is the triple displacement 3× per increment, as has been noted earlier.

It can also be seen that the pickle conveyor belt and the magazine belt 3 are inclined somewhat obliquely with respect to the jar conveyor belt 5, resulting in a difference in the level of the contents of the magazines with respect to the jars which is in proportion with the passage of the magazines 4 past the jars. This is important as the process of layering the individual pickle quarters in the jars continues.

The process will now be described in detail in functional terms, referring to FIGS. 1–3. Pickles are first placed in the carrying dishes 26 of the pickle conveyor belt 1. The belt travels from left to right as seen in FIG. 1. With their upper end (as seen in FIG. 1), the pickles thereby run up against a stop bar 40. There they are cut to a predetermined length by the knife 41 and having this length rest in the carrying dish 26.

In this initial position, in which all the belts are in a state of rest between two travel increments, the feed bar 7 executes a stroke. Upon this stroke, the following events take place:

(a) The cutting pistons 8, 9, 10 push the pickles, which are located in positions 1, 3, 5, into the cutting stations 16, 17, 18 via the centering devices 19, 20, 21. In the cutting stations the pickles are cut into quarters. As a result of the slotted embodiment of the pistons 8–10, the pickles are pushed still farther until they are inside the magazines 4, which are likewise located in these positions 1, 3, 5.

Figure 5:
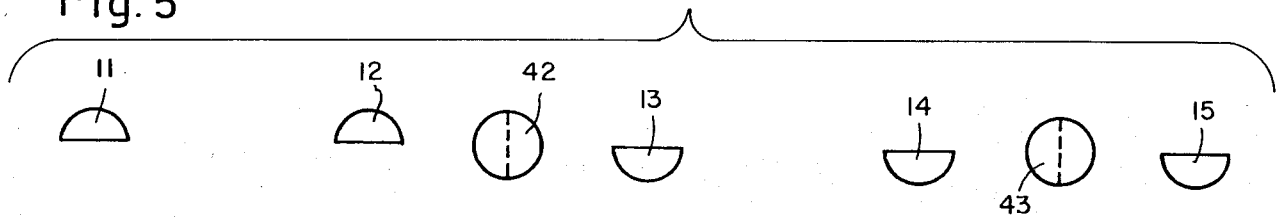
FIG. 5 is a section taken along the line V—V of FIG. 1.

(b) The feed piston 11, with its end face (see the cross section shown in FIG. 5), engages the pickle quarters located above the partition 25 in the magazine 4 at position 7 (that is, filling station I), which comprise the upper half of the pickle in the magazine 4, and pushes them into a jar 6 at position 7. As may be seen in FIGS. 2 and 3, the result is a position in which the cut sides of the pickle quarters face outward.

Figure 3:
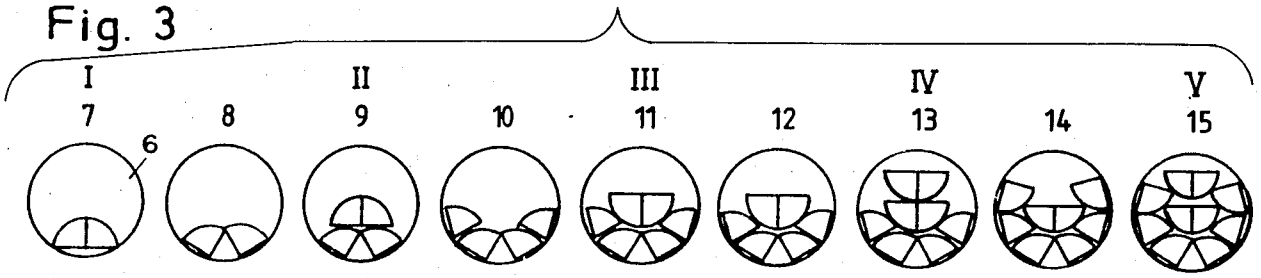
FIG. 3 is a section taken along the line III—III of FIG. 1 (again in schematic fashion)

(c) The feed piston 12 (see the cross section in FIG. 5), in position 9 (that is, filling station II), pushes the quarters comprising the upper half of the pickle in the magazine 4 located at position 9, that is, a pickle half which likewise is resting on partition 25, into the jar in that same position in such a manner that the cut sides face downward (see FIGS. 2 and 3).

(d) The alignment mandrel 42 reaches into the jar in position 10 and there divides the two quarters, which in position 9 were introduced into the jar while still lying beside one another, such that they are pushed to the side and rest with their cut side facing outward against the wall of the jar (see FIG. 3).

(e) The feed piston 13 (see the cross section in FIG. 5) pushes the two lower quarters in the magazine 4, in position 11 (filling station III), into the jar in position 11 in such a manner that these quarters assume the position shown in FIG. 3 and fill up the middle of the jar.

(f) The feed piston 14 (see the cross section in FIG. 5) pushes the quarters which are the lower half of the pickle out of the magazine in position 13 (filling station IV) into a jar in such a manner that they rest on the two quarters which had been placed in the jar in filling station III.

(g) The alignment mandrel 43 reaches into the jar in position 14 and divides the two quarters which had been placed in the jar in filling station IV in such a manner that they are spaced apart and assume the position shown in FIG. 3, with the cut sides facing outward.

(h) The feed piston 15 (see the cross section in FIG. 5) pushes the two quarters which are the lower half of the pickle in position 15 (filling station V) into the jar in the same position in such a manner that again the cut sides face outward.

With these events, the operations of cutting, filling and alignment for one stroke of the feed bar are completed. Of the three pickles which were cut per stroke, five halves have been inserted into the jars, that is, in filling stations I–V; the remaining half is ejected at the bottom as the belt makes its return to the beginning position. The jar is carried further on the jar conveyor belt 1 and then is filled to completion by hand at the work station 50, further pickle pieces being inserted until the jar is compactly filled in the desired manner.

Once the feed bar 7 has returned to its initial position, then all the belts move forward by one increment. In detail, this means the following:

The jars 6 each move forward by one interval ×; The magazines 4 move forward by one interval 6×; the carrying dishes 26 move forward by one interval 3×. The next stroke of the feed bar 7 then takes place.

The course of this movement will now be described once again in detail, but in terms not of the individual cutting and feed pistons 8–15 and the alignment mandrels 42, 43 out rather of the individual pickles, that is, in terms of the filling of the jars.

Upon each stroke, three pickles are cut, that is, in positions 1, 3, 5. Upon the next stroke, these pickles are located in positions 7 (filling station I), 9 (filling station II), 11 (filling station III). In the filling stations I and II the upper halves of the pickles which were cut in positions 1 and 3, are pushed out; in filling station III the lower half of the pickle which was cut in position 5, is ejected.

After the next increment the pickle which was originally cut in position 1 and the upper half of which was then ejected in position 7 is now located in position 13 (filling station IV), where its lower half is ejected. At the same time, the pickle which was originally cut in position 3 and the upper half of which was ejected in filling station II is now located in filling station V, where its lower half is ejected.

The upper half of the pickle which is cut in position 5, and the lower half of which is placed in the jar in filling station II, is not used. As noted, it is removed, upon the return passage of the belt below the plane of the drawing in FIG. 1, from the corresponding magazine in an arbitrary manner (for instance being blown out with compressed air).

Because the pickle conveyor belt 1 advances by the distance of 3× upon each increment, each pickle is cut only once. For instance, the pickle which is cut in position 1 is moved forward during the next stroke to position 4, and upon the next subsequent stroke it is then moved to position 7 (filling station I), and so forth.

The jars are then filled in the sequence shown in FIG. 3. In position 7, an upper half of a pickle is inserted (this is in filling station I). In position 8 this pickle falls apart somewhat as shown. In position 9 (filling station II), the upper half of a different pickle is added. This half is divided in position 10 in such a manner that it rests with its cut sides against the wall of the jar. In position 11 (filling station III), the lower half of still another pickle is added. It remains there, as may also be seen in position 12. In position 13 (filling station IV), the lower half of another pickle is added, which is divided in position 14 such that it too rests with its cut sides facing outward against the jar. The space between them is then filled in position 15 (filling station V) with a further lower half of a pickle, so that again the cut sides face outward. The rest of the jar is then filled completely by hand at the work station 50.

What is claimed is:

1. A machine for filling jars with pieces of vegetables or fruits, and in particular quartered pickles, comprising:

a plurality of cutting stations;

a conveyor belt on which the vegetables or fruits are carried in a horizontal position and by which they are carried and moved in increments to the cutting stations, while the horizontal orientation is maintained;

a plurality of filling stations;

a magazine conveyor belt defining a path of travel, on which a plurality of magazines are carried and moved incrementally to the cutting statons and the filling stations, each magazine being provided with a partition for dividing the spaced within the magazine into two portions;

means for cutting the vegetables or fruits at the cutting stations into pieces and for feeding the cut pieces into the magazines at the cutting stations, such that a portion of the cut pieces at each cutting station are received within one portion of an associated magazine and rest on the partition thereof and the remainder of the cut pieces at each cutting station are received within the other portion of the associated magazine;

a jar conveyor belt having an upper horizontal plane defining a path of travel, on which a plurality of jars are carried and moved incrementally to the filling stations; and means for feeding the cut pieces from the magazines at the filling stations into the jars at the filling stations, wherein:

(i) the path of travel of the magazine conveyor belt is disposed parallel relative to the path of travel of the jar conveyor belt and obliquely relative to said horizontal plane, such that (ii) the height of the magazine relative to a jar varies at each filling station.

2. The machine as defined in claim 1, further wherein:

(iii) the means for feeding the cut pieces into the jars comprise a feed piston at each filling station.

3. The machine as defined in claim 1, further wherein:

(iii) the jars are spaced apart on the jar conveyor belt by a specific distance from one another, and moved incrementally by said specific distance;

(iv) the magazines are spaced apart on the magazine conveyor belt by twice said specific distance, and moved incrementally by six times said specific distance; and (v) the vegetables or fruits are spaced apart on the vegetables or fruits conveyor belt by said specific distance, and moved incrementally by three times said specific distance.

4. The machine as defined in claim 3, further wherein:

(vi) three cutting stations are provided between the magazine belt and the vegetables or fruits conveyor belt, the three cutting stations being spaced apart by a distance equal to twice said specific distance;

(vii) the cut pieces are fed into magazines from the cutting stations; and (viii) at least three filling stations are provided.

5. The machine as defined in claim 4, further wherein:

(ix) five filling stations are provided, at which the magazines are disposed progressively somewhat higher relative to the jars than in a preceding filling station; and (x) at the first two filling stations, cut pieces located above the magazine partition are fed into a jar, and at the three subsequent filling stations, cut pieces located below the magazine partition are fed into a jar.

6. The machine as defined in claim 1, further comprising:

alignment means disposed between filling stations for the purpose of positioning the cut pieces within a jar.

* * * * *